United States Patent [19]

Ackermann

[11] Patent Number: 4,648,524

[45] Date of Patent: Mar. 10, 1987

[54] COMPARTMENTED STORAGE CONTAINER

[75] Inventor: Henry A. Ackermann, Lynnwood, Wash.

[73] Assignee: Honeywell Inc., Minneapolis, Minn.

[21] Appl. No.: 744,864

[22] Filed: Jun. 14, 1985

[51] Int. Cl.[4] ..... B65D 5/26

[52] U.S. Cl. ..... 220/22; 220/21

[58] Field of Search ..... 220/22, 21, 22.83, 408, 220/410; 206/561

[56] References Cited

U.S. PATENT DOCUMENTS

| | | | |
|---|---|---|---|
| 3,788,002 | 1/1974 | Suchka | 220/21 X |
| 4,013,798 | 3/1977 | Goltsos | 220/22 X |
| 4,065,021 | 12/1977 | Kedzierski | 220/22 |
| 4,202,465 | 5/1980 | McLaren | 220/23.83 X |

*Primary Examiner*—Steven M. Pollard

*Attorney, Agent, or Firm*—Roger W. Jensen

[57] ABSTRACT

A compartmented storage container for use in an automatic parts storage and retrieval system comprising a one-piece thin-wall molded plastic body having a rectangular shape adapted to fit within the rectangular rim of a tray, an outside edge portion, an inside edge portion, a bottom portion and at least one transverse divider wall portion, all of said portions being integral with one another and with the transverse divider wall portion having a vertical height measured from a bottom plane less than the vertical height of the outside and inside edge portion.

2 Claims, 4 Drawing Figures

COMPARTMENTED STORAGE CONTAINER

This invention comprises a compartmented storage container for use in an automatic parts storage and retrieval system (sometimes hereinafter referred to as "AS/RS") wherein such systems comprise generally a plurality of vertically arranged, horizontally disposed, shelves onto which are adapted to be placed, by horizontal sliding movement, a plurality of trays each of which has a flat rectangular bottom portion. The trays further have a vertically extending rim or edge portion around the entire periphery thereof. The trays also typically have means such as handles or tool engaging means for facilitating the horizontal movement of the trays onto and off of the shelves by computer controlled robot apparatus. The trays typically are aboaut 2'×4' in horizontal dimensions and vary in vertical height in accordance to the size of the items to be stored.

Each vertical stack of shelves may extend from the floor vertically ten feet or more depending upon the height of the ceiling of the room or warehouse in which the automatic parts storage and retrieval system is located. The system typically comprises a large number of such stacks arranged in two opposing or facing rows with an aisle or alley defined therebetween. Further, an automatic trolly or truck-like robot device is computer controlled from a remote station so as to fetch a particular specified tray and to bring the tray to the control station where a human operator and/or automatic apparatus, e.g., robot, can remove part or all of the contents of the tray or add more items to the tray.

AS/RS systems have been known for some time. For example, the Kenway Division of the Eaton Company sells and distributes such systems.

In the past, users of such systems have sometimes added compartments within the tray so as to facilitate the use of a single tray for the storage of more than one kind of part. For example, it is well known to take a plurality of cardboard boxes and to have them arranged open side up within a tray for parts storage. There were a number of disadvantages associated with this type of arrangement.

BRIEF SUMMARY OF THE INVENTION

The compartmented storage container provided by this invention comprises a one-piece thin wall molded plastic body (molded for example by use of a vacuum molding process) where the body has a rectangular shape adapted to fit conveniently within the rectangular rim and on top of the bottom portion of one of the aforesaid described trays. The body further has an outside edge portion extending around the entire periphery of the body, the outside edge portion extending from a bottom plane upwardly substantially parallel to the vertical of the AS/RS a distance substantially equal to vertical height of the aforesaid tray rim to a t plane at which point the material is rolled over with an integral top rounded surface and thence downwardly with an integral inside edge portion extending to the bottom plane, the inside edge portion being substantially parallel to the outside edge portion.

The one-piece thin-wall molded plastic body further comprises a bottom portion lying in or adjacent to the bottom plane and being integrally connected to the aforesaid inside edge portion at the bottom thereof. The body further includes at least one transverse divider wall portion integral with the bottom portion and integrally connected at its two ends to the inside edge portion. The transverse divider wall portion extends along the vertical axis upwardly from the bottom plane a substantial distance but, nevertheless, a significant distanse less than the total vertical extent of the outside edge portion. In this manner the transverse divider wall portion defines at least two seamless parts storage compartments. Any desired number of transverse divider portions may be provided. In one configuration the multiple transverse divider portions are all parallel to one another. In other configurations the transverse divider members are perpendicular to one another. In all cases the transverse divider portions extend, as aforesaid, only part way vertically up toward the top plane by being significantly shorter along the vertical axis than the outside edge of the body. This has the advantage of providing convenient parts storage compartments but prevents "bulk" parts from being stored so high in the compartment that they would possibly physically obstruct the movement of the tray containing the body in and out of the AS/RS, it being recognized that such obstruction could either jam the automatic machine and/or the parts in question causing the obstruction being damaged due to the physical interference between the movable trays, bodies and parts and the fixed shelves of the AS/RS.

DETAILED DESCRIPTION

Figure 2:
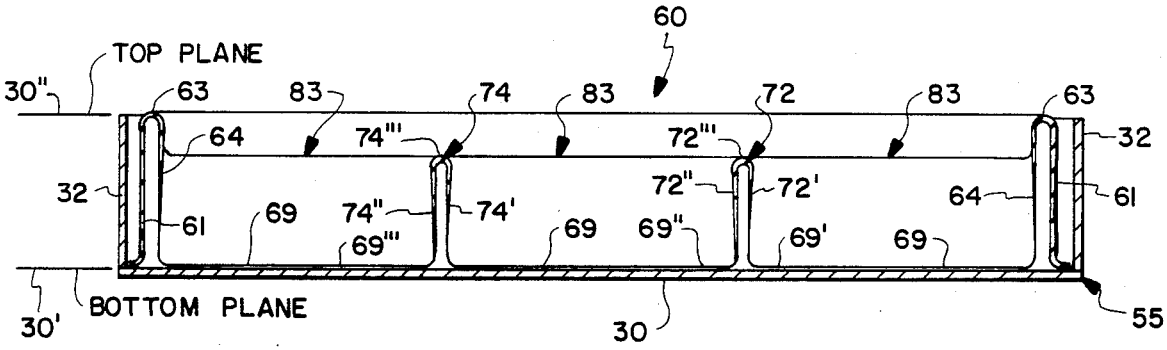
FIG. 2 is an enlarged cross-sectional view of the apparatus shown in FIG. 1 as viewed along section lines 2—2.
Figure 3:
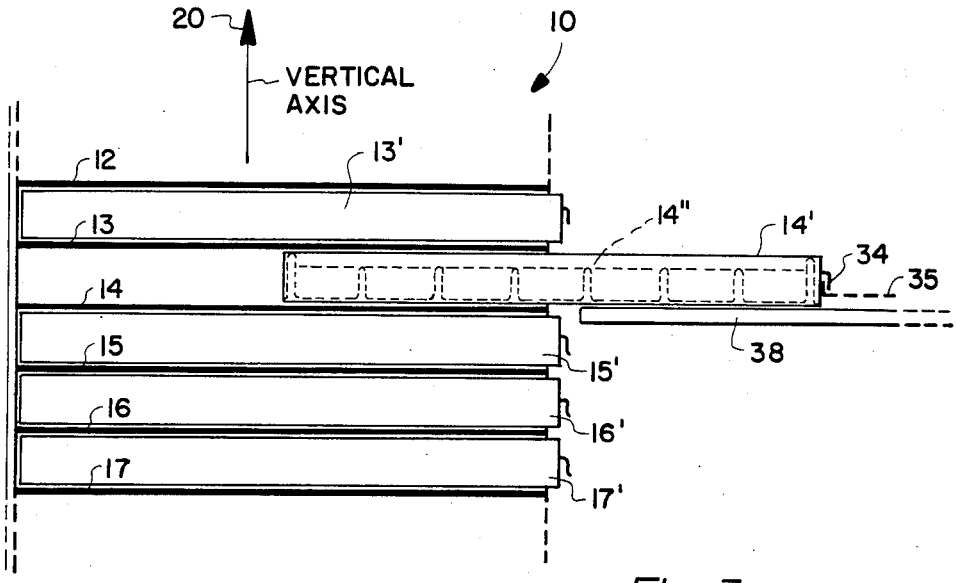
FIG. 3 is a partial cross-sectional view of an AS/RS in which a tray is shown partially removed from a stack of vertically arranged shelving and trays.

Referring first to FIG. 3, an automatic parts storage and retrieval system 10 is partially shown, the portion shown comprising a plurality of vertically arranged horizontally disposed shelves 12, 13, 14, 15, 16 and 17. The vertical axis of the AS/RS 10 is identified by reference numeral 20. The shelves 12–17 are shown in spaced-apart parallel relationship with the spaces in between being equal. It will be understood that the vertical spacing between each adjacent shelf may be selected according to the desires of the users. A plurality of trays 13', 14', 15', 16' and 17' are respectively placed on and are supported by shelves 13, 14, 15, 16 and 17. Each of the trays has a flat rectangular bottom portion 30 (see FIG. 2) and a vertically extending rim portion 32 (see FIGS. 1 and 2). A handle or equivalent means 34 is provided on the rim portion 32 that faces out from the AS/RS 10 (as depicted in FIG. 3) so as to permit the engagement therewith by suitable mechanical means 35, e.g., a hook, so as to permit the removal of a tray from the vertical stack by horizontal movement from the stack out onto an appropriate support means 38. As is well understood by those skilled in the art of AS/RS, the tray would be totally moved out of the vertical stack onto the support means 38 and, under the control of an automatic transfer system, the entire tray (tray 14' as shown in FIG. 3) would be transferred to an appropriate work station where parts could be removed from the tray and/or added to the tray.

Figure 1:
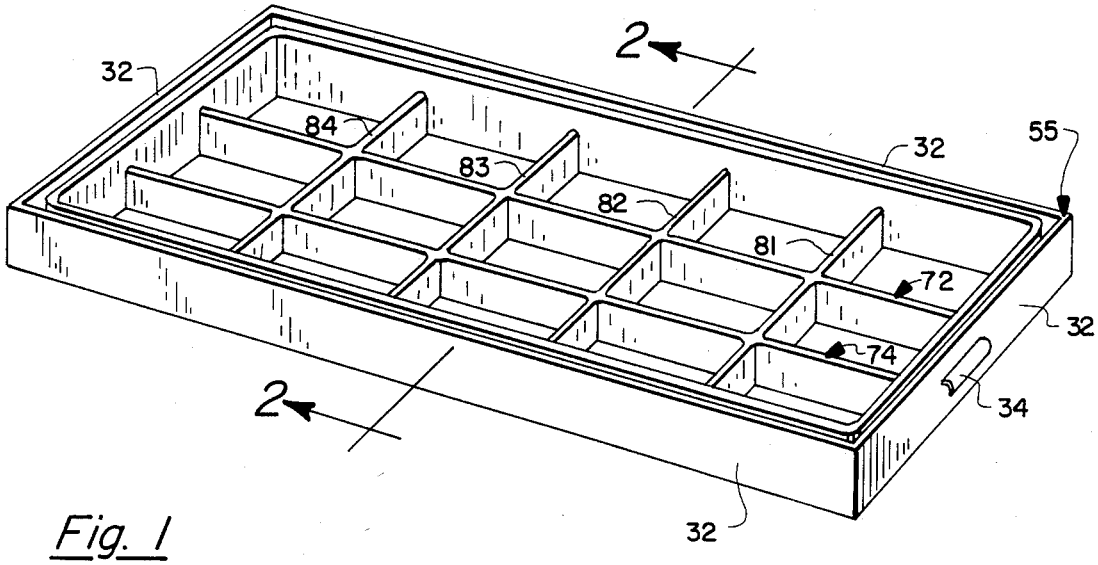
FIG. 1 is an isometric view of a tray containing a compartmented storage container exemplifying my invention.

My unique compartmented storage container is shown in appropriate detail in FIGS. 1 and 2, the container comprising a one-piece thin-wall molded plastic body generally designated by reference numeral 60. The body 60 has a rectangular shape adapted to fit within the rectangular rim 32 of the tray 55 shown in FIGS. 1 and 2. Further, the body 60 is adapted to rest on top of the bottom portion 30 of the tray 55, the top surface of body portion 30 defining a bottom plane 30'.

The body further comprises an outside edge portion 61 extending around the entire periphery of the body. The outside edge portion 61 extends from the bottom plane 30' upwardly substantially parallel to the vertical axis 20 a distance substantially equal to the top of the rim 32 which is designated in FIG. 2 by top plane 30''. At the top of the outside edge portion 61 the body material is rounded over so as to define an integral top rounded surface 63; thence the body material extends downwardly to define an inside edge portion 64. The inside edge portion 64 extends to the bottom plane 30' and integrally connects with a bottom portion 69. The bottom portion 69 by definition is substantially coplanar with the bottom plane 30'.

At least one transverse divider wall portion is provided with my invention. In the embodiment shown in FIGS. 1 and 2 there are a plurality of transverse divider portions. More specifically there are two longitudinally extending transverse divider wall portions 72 and 74 and four lateral extending transverse divider wall portions 81, 82, 83 and 84. Each of the transverse divider wall portions 72, 74, 81–84 are integral with the bottom portion 69. For example, with reference to FIG. 2, it is seen that the transverse divider wall portion 72 comprises a first side 72' which is integral with the material of the bottom portion 69 which for convenience has a reference numeral 69' and the other side of the divider 72 is identified by reference numeral 72'' and it is integral with the bottom portion 69''. The two sides 72' and 72'' of the divider wall portion 72 are integrally connected by a rounded top surface 72'''. In the same manner the transverse divider wall portion 74 has a first side 74' integrally connected to the bottom portion 69''. A second side 74'' is integrally connected at the bottom thereof to a bottom portion 69'''. The two vertical sides 74' and 74'' of the divider wall portion 74 are integrally connected at the tops thereof by a rounded portion 74'''. As viewed in FIG. 1, it will be noted that all transverse divider wall portions are integral at the ends thereof with the inside edge portions 64.

The transverse dividers extend from the bottom plane 30' along the vertical axis a substantial distance so as to define a plurality of seamless parts storage compartments having convenient parts storage capacity; however, the vertical height of the transverse divider wall portions is substantially less than the vertical height of the rounded edge 63 of the body. This provides a significant advantage given the intended use in an AS/RS system. More specifically the dividers tend to provide a top limit for parts stored in the compartments, i.e., parts tend to be leveled off at a point no higher than the top surface of the dividers. This tends to eliminate any possibility of parts being accidentally placed in a compartment so as to project above the top plane 30'' raising the risk of the jamming of the AS/RS when the tray is returned into the vertical stacks depicted in FIG. 3. As aforesaid, this arrangement prevents damage to the AS/RS and/or the parts in question.

The one-piece thin-wall molded plastic body compartmented storage container may be molded using vacuum molding techniques. Preferably the plastic material utilized for the body has anti-static properties to facilitate the use of the body for storage of components which either must be protected, per se, or are intended for use in electronic/electrical apparatus where static build-up is not desired. Furthermore a suitable plastic is desired that will be neutral, i.e., not have any outgassing of chemicals that would be adverse to the items being stored.

Figure 4:
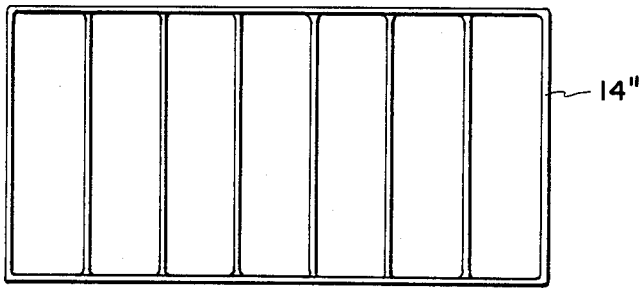
FIG. 4 is a top view of the compartmented storage container depicted in FIG. 3.

The body 60 depicted in FIGS. 1 and 2 has a total of fifteen compartments, all of equal size. The body embodiment 14'' depicted in FIGS. 3 and 4 provides a total of seven compartments, again all of equal size. It will be appreciated that an almost unlimited range of designs is available for the layout of the individual compartments depending upon the volume required for the individual part to be stored.

Since many variations are available, it will be understood that my invention should be limited only by the scope of the appended claims.

I claim:

1. A compartmented storage container for use in an automatic parts storage and retrieval system comprising, in part, a plurality of verticaly arranged, horizontally disposed, shelves onto which are adapted to be placed, by horizontal sliding movement, a plurality of trays each of which has a flat rectangular bottom portion, a vertically extending rim portion, and means for facilitating horizontal movement of said trays onto and off of said shelves, said compartmented storage container comprising a free-standing one-piece thin-wall molded plastic body having:

(a) a rectangular shape adapted to fit within the rectangular rim and on top of the bottom portion of one of said trays;

(b) an outside edge portion extending continuously around the entire periphery of said body, said outside edge portion extending from a bottom plane upwardly substantially parallel to the vertical axis a distance substantially equal to the height of the aforesaid rim to an integral and continuous top rounded surface and thence to an inside edge portion integral thereto extending to said bottom plane and substantially parallel to said outside edge portion;

(c) a bottom portion lying adjacent to and parallel to said bottom plane and integrally connected to said inside edge portion; and (d) at least one vertically oriented transverse divider wall portion integral with said bottom portion, integrally connected at its two transverse ends to said inside edge portion, and extending along the vertical axis a substantial distance, said divider wall portion being further characterized by:

(i) having double vertically extending walls each integrally connected at the bottom end thereof to said bottom portion and integrally connected to each other at the top end thereof with an integral top rounded surface, and (ii) being substantially shorter along the vertical axis than said outside edge portion, whereby at least two seamless parts storage compartments are collectively defined by said bottom, transverse divider wall portion and inside edge portion, said compartments being further characterized by all upper edges thereof being integral rounded surfaces, and whereby said storage container is free standing and self-supporting within said rectangular rim and on top of said bottom portion of said one of said trays.

2. Apparatus of claim 1 further characterized by including at least one additional transverse wall portion integral with said bottom portion and said inside edge portion, positioned perpendicular to said first recited transverse divider wall portion, also having double vertically extending walls each integrally connected at the bottom end thereof to said bottom portion and integrally connected to each other at the top end thereof with an integral rounded surace, and having a vertical height (measured from said bottom plane) substantially the same as the vertical height of said first recited transverse divider wall portion, whereby at least one of said compartments is subdivided.

* * * * *